US009376876B2

(12) United States Patent
Edwards

(10) Patent No.: US 9,376,876 B2
(45) Date of Patent: Jun. 28, 2016

(54) BORE SELECTION APPARATUS

(71) Applicant: Enovate Systems Limited, Aberdeen, Aberdeenshire (GB)

(72) Inventor: Jeffrey Edwards, Aberdeen (GB)

(73) Assignee: Enovate Systems Limited (GB)

( * ) Notice: Subject to any disclaimer, the term of this patent is extended or adjusted under 35 U.S.C. 154(b) by 0 days.

(21) Appl. No.: 14/408,749

(22) PCT Filed: Jun. 18, 2013

(86) PCT No.: PCT/GB2013/051585
§ 371 (c)(1),
(2) Date: Dec. 17, 2014

(87) PCT Pub. No.: WO2013/190284
PCT Pub. Date: Dec. 27, 2013

(65) Prior Publication Data

US 2015/0176353 A1 Jun. 25, 2015

(30) Foreign Application Priority Data

Jun. 19, 2012 (GB) ..... 1210884.1

(51) Int. Cl.

| | |
|---|---|
| ***E21B 43/013*** | (2006.01) |
| ***E21B 23/00*** | (2006.01) |
| ***E21B 43/10*** | (2006.01) |
| ***E21B 23/12*** | (2006.01) |
| ***E21B 17/18*** | (2006.01) |
| ***E21B 34/04*** | (2006.01) |

(52) U.S. Cl.
CPC ..... *E21B 23/002* (2013.01); *E21B 17/18* (2013.01); *E21B 34/04* (2013.01)

(58) Field of Classification Search
None
See application file for complete search history.

(56) References Cited

U.S. PATENT DOCUMENTS

| | | | | |
|---|---|---|---|---|
| 4,470,247 | A | 9/1984 | Mast | |
| 5,129,459 | A | 7/1992 | Breese et al. | |
| 5,377,762 | A * | 1/1995 | Turner | B65G 53/56 166/320 |
| 6,170,578 | B1 | 1/2001 | Edwards et al. | |

FOREIGN PATENT DOCUMENTS

| | | |
|---|---|---|
| GB | 2258675 | 2/1993 |
| GB | 2362400 | 11/2011 |

* cited by examiner

*Primary Examiner* — Matthew R Buck
*Assistant Examiner* — Douglas S Wood
(74) *Attorney, Agent, or Firm* — Tarolli, Sundheim, Covell & Tummino LLP

(57) ABSTRACT

A bore selection device for use with a dual bore subsea system is disclosed. The bore selector (18) can be remotely actuated to provide selection between a production bore (12) and an annulus bore (16) without a rotating mechanism or flapper valve. Embodiments of the invention are disclosed. In one embodiment a pair of rams (20) having a ram head (20*a*, 20*b*) defining parts of a guide funnel (30*a*, 30*b*) are hydraulically actuatable so that when the rams are actuated and closed the guide funnel (30) is formed which couples a part of the production bore (126) to the annulus bore (16*a*).

15 Claims, 4 Drawing Sheets

Figure 1:
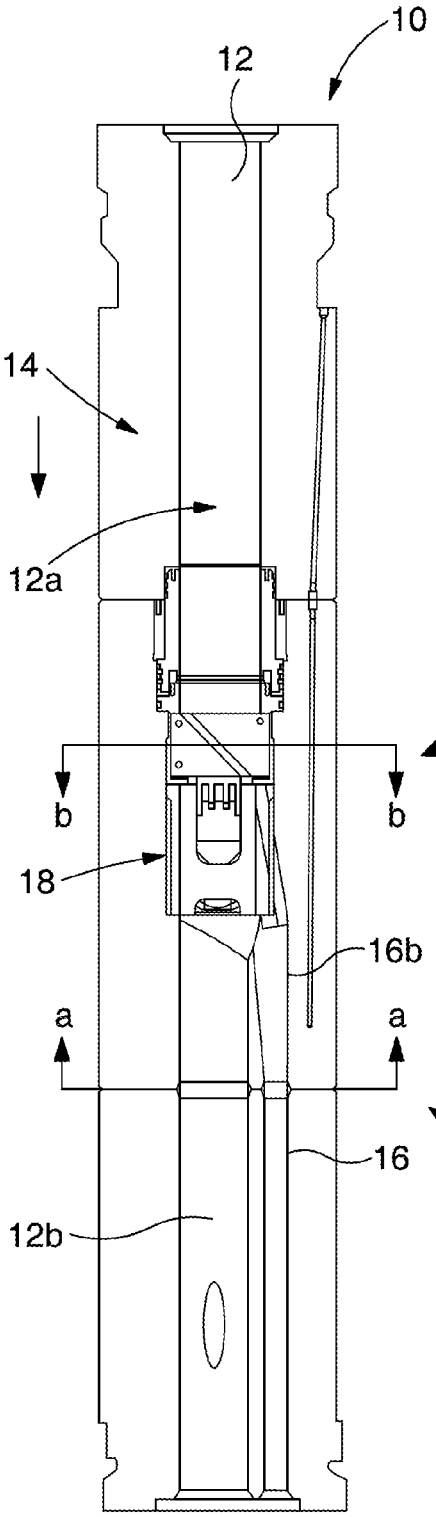

Fig. 4a
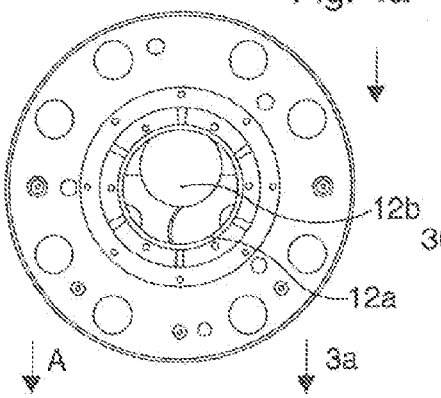
Fig. 4b
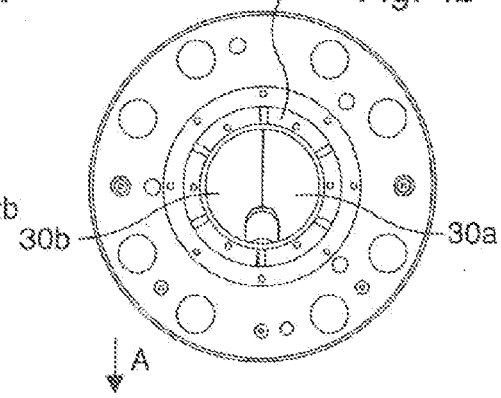
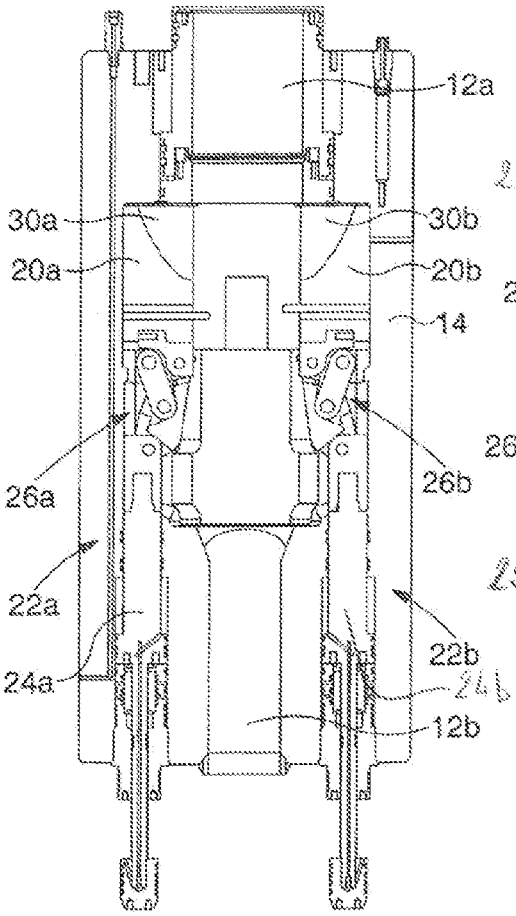
Fig. 3a
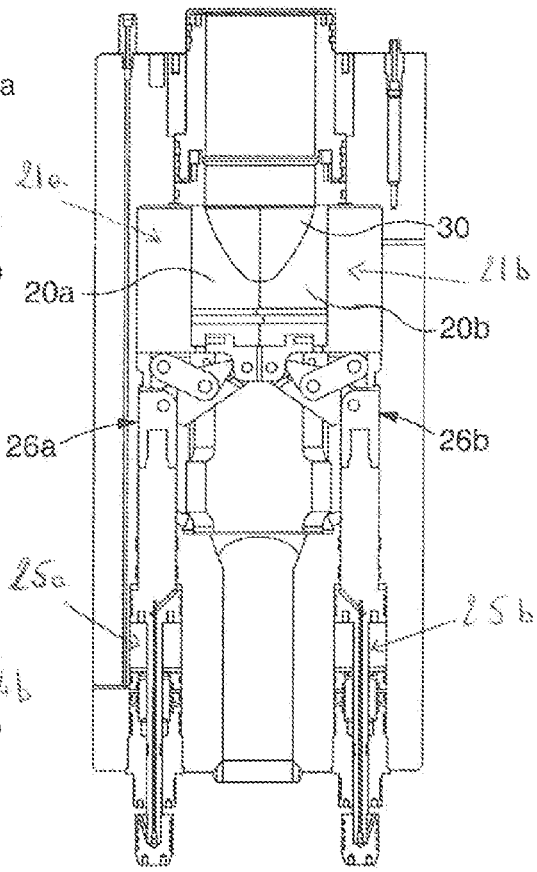
Fig. 3b

BORE SELECTION APPARATUS

FIELD OF THE INVENTION

The present invention relates to a bore selection device for selecting between a production bore and an annulus bore of a sub-sea well system.

A bore selector is typically disposed within the intervention riser and can be coupled between casing or tubing and a sub-sea production tree. There have been various proposals for providing a device with a single passage at an upper end and two or more passages at a lower end and means within the device for selecting one of the passages so that a tool passing through the device can be directed through a selected passage. Examples of such devices are disclosed in U.S. Pat. No. 4,770,247, U.S. Pat. No. 5,129,459, U.S. Pat. No. 6,170,578 and UK application publication number GB2258675A.

The traditional way of selecting between two bores in a dual bore system is to use a whipstock, which is normally a plug that is inserted into the well to change direction and guide a tool into a selected bore. However, running a whipstock has to be done in wire line to block a production bore and this is both time consuming and consequently expensive. Whipstock solutions are disclosed in the above mentioned U.S. Pat. Nos. 4,770,247, 5,129,459 and 6,170,578. However with the '247 and '459 patents, the mechanism for selecting between bores is an internal rotary mechanism. These mechanisms are very complex and expensive and, in order to work efficiently and effectively, need to be accurately aligned and rotated so that there is a correct alignment within the bore in order for the selection to work properly. With regard to the '578 patent, this requires the use of a flapper valve which includes a hinged flapper plate located within the device, which is actuated to move about a pivot so as to selectively open or close an annulus bore and a production bore. This arrangement has the problem that the force generated by the flapper valve is generally weak leading to reliability issues with valve closure.

An object of the present invention is to provide an improved bore selection device for facilitating access for a monobore riser to a production bore or to an annulus bore which obviates or mitigates at least one of the aforementioned problems with the prior art solutions.

This is achieved by providing a bore selection device which can be remotely actuated to provide selection between a production bore and an annulus bore without requiring a rotation mechanism or a flapper valve mechanism.

The bore selector device can be actuated from the surface or from an ROV to provide a coupling between the tubing bore and the production bore and the smaller annulus bore.

According to the present invention, there is provided a bore selection device for use with a dual bore sub-sea system, said bore selection device comprising:

- a housing having a longitudinal axis, said housing defining a production bore and an annulus bore, said production bore being of a diameter larger than said annulus bore and extending the length of the housing, said annulus bore extending part-way along the length of said housing;
- bore selector means, such as a bore selector, movable between a first position wherein the production bore is open and said annulus bore is closed and a second position wherein the production bore is closed and said annulus bore is open;
- the bore selector being coupled to actuation means, such as an actuator, by coupling means, such as a coupler, said actuator and coupler being disposed in said housing, said actuator being movable substantially parallel to said production bore, said coupler coupling said coupler to said bore selector to transform longitudinal movement of said actuator to transverse movement of said bore selector to said production bore whereby said bore selector is moved between said first and said second positions.

Conveniently, the housing has an internal wall defining cavities for receiving at least two actuators, said actuators being arranged to move in said well in the direction parallel to the longitudinal axis.

Preferably also the bore selector includes two separate rams. Conveniently said rams are equal in size and are dimensioned and proportioned so that in a first position when the production bore is open, each ram is located within a recess in said housing wall such that the production bore is not obstructed. Preferably also the coupler couples each actuator to a respective ram and includes a linkage, said linkage being located within the wall of said housing. Conveniently said actuators is a hydraulic system.

Preferably also when said actuator is hydraulically actuated to close said production bore, hydraulic pistons engage the linkage which acts on respective rams to move the ram in a direction substantially orthogonal to the direction of said actuator so that the rams move together to close said production bore and define a guide funnel through said closed rams whereby a portion of said production bore is coupled to said annulus bore.

Alternatively the bore selector can be provided by any suitable number of rams—for example 3, 4, or more—with the ram heads defining part of a guide funnel such that when the rams are actuated and closed the guide funnel is formed. In a yet further implement a single ram may be provided with a complete guide funnel which is dimensional and proportioned to fit in the wall of the housing when the production bore is open.

Preferably also said coupler is provided by a 4-pin linkage which acts to convert the longitudinal force of the hydraulic actuator within the bore selector device to an orthogonal force whereby said rams move transverse to open and close the selected bores.

Conveniently the coupling mechanism is a two latch linkage. Alternatively the coupling mechanism can be a three or other suitable latch linkage sufficient to convert the longitudinal movement of the actuator into orthogonal movement to move the rams to open and close the bores.

According to a further aspect of the present invention there is provided a method of selecting a bore within a dual bore sub-sea device having a production bore and a separate annulus bore, said method comprising the steps of:

- actuating a first actuator to move in a first direction substantially parallel to the production bore of the dual sub-sea device;
- coupling the longitudinal movement of the actuator to at least one ram via a coupler for converting the longitudinal movement to substantially transverse movement of said ram, said transverse movement of said ram moving between a first position wherein the production bore is open and a second position wherein the production bore is closed.

Preferably said coupler transforms the longitudinal movement to transverse movement which is substantially orthogonal to the longitudinal movement so that said rams move between said first and second positions in a plane which is substantially orthogonal to the longitudinal access of said device.

Preferably also the method includes creating a funnel when said rams are closed which couples the production bore to the annulus bore.

Preferably also the method includes the step of actuating at least two hydraulic pistons and two separate rams to move orthogonally to said hydraulic pistons means in opposite directions to provide said open and closed positions.

Figure 2C:
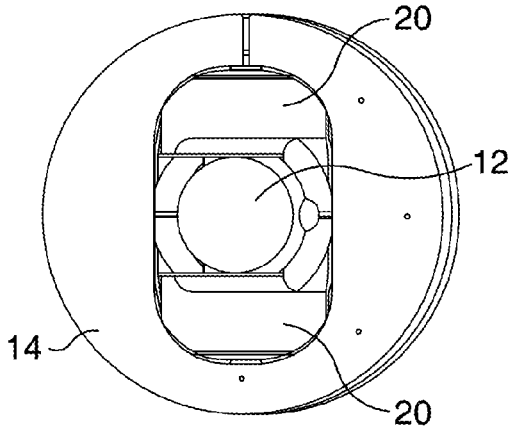
Figure 2B:
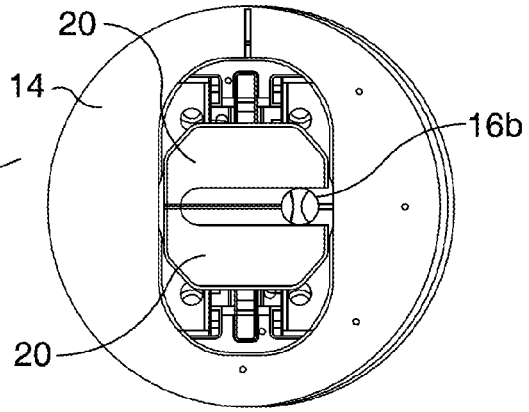
Figure 2A:
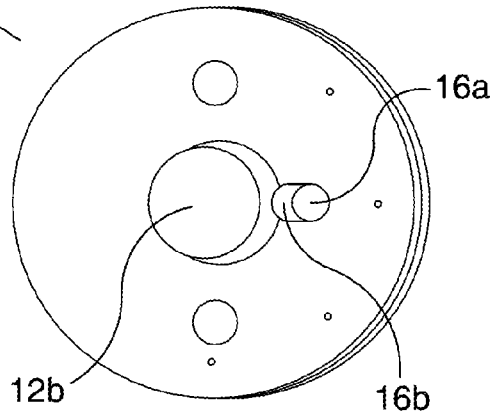
Figure 5A:
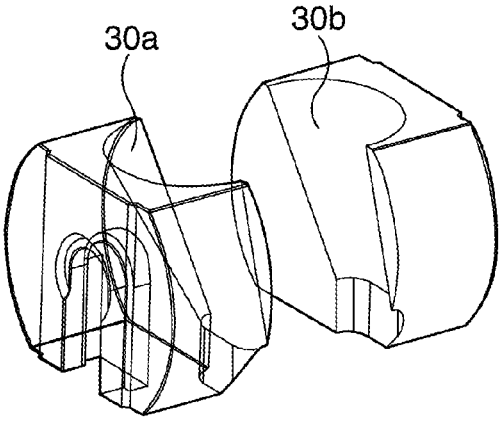
Figure 5B:
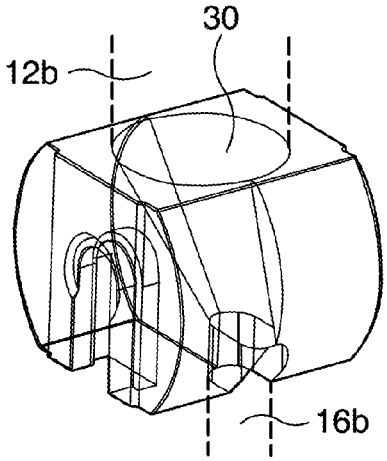
Figure 6A:
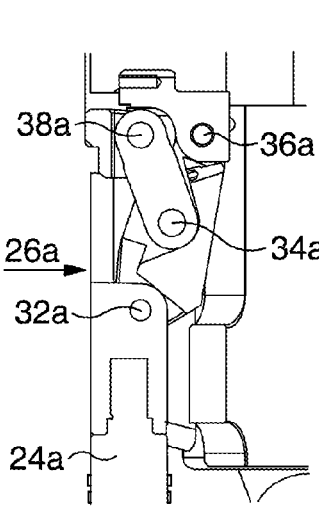
Figure 6B:
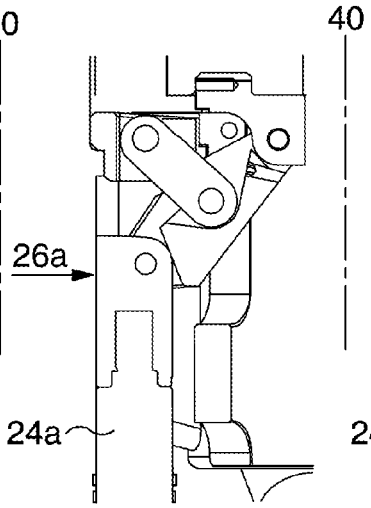
Figure 6C:
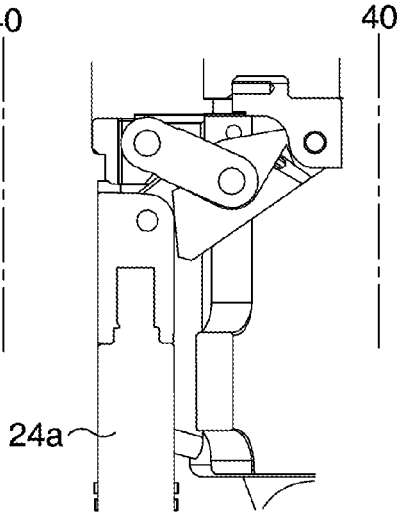
Figure 7:
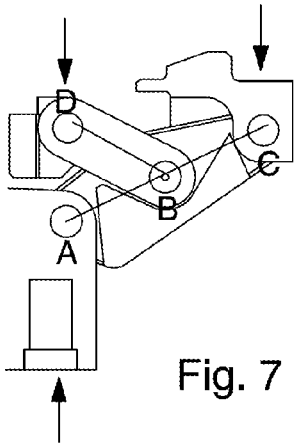

These and other aspects of the present invention will become apparent from the following description when taken in combination with the accompanying drawings in which:

FIG. 1 is a longitudinal partial sectional view of a bore selector device in accordance with an embodiment of the present invention;

FIG. 2*a* is a cross sectional view taken through the device of FIG. 1 on lines a-a;

FIG. 2*b* is a cross sectional view taken through the device of FIG. 1 on lines b-b with the bore selector mechanism in a closed position;

FIG. 2*c* is a cross sectional view taken through the device of FIG. 1 on lines b-b with the bore selector mechanism in an open position;

FIGS. 3*a*, 3*b* are detailed longitudinal section views of the bore selection device with the bore selection mechanism shown in the open and closed positions respectively;

FIGS. 4*a*, 4*b* are top views taken of FIGS. 3*a*, 3*b* respectively in the directions of arrow A;

FIGS. 5*a* and 5*b* are an enlarged perspective view illustrating the funnel shape provided by the rams when in the open and closed position respectively;

FIGS. 6*a*, 6*b* and 6*c* are enlarged side views of one half of the ram link mechanism of FIG. 3 with the mechanism shown in the open, partially closed and closed positions respectively;

FIG. 7 is a schematic illustrating how the ram-link mechanism translates axial to transverse movement, and FIGS. 8*a*-8*e* illustrate the bore selector actuator to allow a long drift to pass through the bore selector into the annulus bore.

Reference is first made to FIG. 1 of the drawings, which depicts a longitudinal partial sectional view of a bore selector apparatus 10 in accordance with an embodiment of the invention. The bore selector apparatus as illustrated is about 1.5 meters long with an 18.5 inch (outside) diameter. In FIG. 1 it will be seen that the bore selector apparatus has a main/production bore 12 which extends the length of the apparatus defined by a housing generally indicated by reference numeral 14 and an annulus bore 16 which extends through the lower part of the apparatus to a bore selector mechanism generally indicated by reference numeral 18 the detail structure and operation which will be described later. As described, operation of the selector mechanism 18 will allow the top part of the bore indicated by reference numeral 12*a* to be selectively connected to the lower part of the bore 12*b* or to the annulus 16 (not shown in this view in the interests of clarity).

Reference is now made to FIGS. 2*a*, 2*b* and 2*c*, which are cross sectional views taken on the lines a-a, b-b of FIG. 1. Referring first to FIG. 2*a* it will be seen that in this sectional view, bores 12*b* and 16 are separate and that bore 16 has a portion 16*a*, which slopes towards the main bore 12*b* and selector mechanism 18. FIG. 2*b* is a cross sectional view of lines b-b which depicts the selector mechanism 18 in a closed position to provide access from the production bore 12*a* to the annular bore 16 is through the sloped annulus portion 16*b*. FIG. 2*c* illustrates the bore selector mechanism in an open position illustrating the continuity of the bore 12 through bore portions 12*a* and 12*b* with the rams 20*a*,20*b* being moved to a retracted position. As will be explained, operation of the mechanism 18 moves between an open and closed position to allow the rams 20*a*,20*b* to close and prevent access to bore 12*b* while allowing access through to sloping annulus portion 16*b* and portion 16 to allow tools to be inserted into the annulus to be guided by the selector mechanism from bore portion 12*a* to annulus 16 as will be later described.

Reference is now made to FIGS. 3*a* and 3*b* of the drawings which are longitudinal sectional views of part of the bore selector shown in FIG. 1 and show the bore selector mechanism 18 in more detail. FIG. 3*a* illustrates the bore selector mechanism in the open position and FIG. 3*b* illustrates the mechanism in the closed position. It will be understood that the bore selector mechanism consists of two opposing parts 22*a* and 22*b* which are retained in the wall of housing 14. The top view shown in FIG. 4*a* taken in the direction of arrow A, shows that in the open position the bore 12*a* passes through the selector mechanism but narrows slightly through to bore 12*b*. The structure of one half of the selector mechanism 22*a* will now be described in detail in the interests of clarity, although it will be understood that the description is also applicable to the other half 22*b*. Portion 22*a* has a hydraulic piston 24*a* coupled to a 4-pin linkage mechanism generally indicated by reference numeral 26*a* which in turn is coupled to ram 20*a*. In FIG. 3*a*, the hydraulic pistons are at their lowermost position such that the 4-pin linkage 26 is in the position as shown in FIG. 3*a* with the coupled ram heads 20*a*,20*b* retracted to allow passage through the main bore 12*b* shown in FIG. 4*a*.

The housing 14 has an internal wall defining cavities 25*a*, 25*b* for receiving the rams 20*a*,20*b*, said rams 20*a*,20*b* being arranged to move in the cavities 25*a*,25*b* in a direction parallel to the longitudinal axis.

In this embodiment, the rams 20*a*,20*b* are equal in size and are dimensioned and proportioned so that in a retracted position when the production bore is open, each ram 20*a*,20*b* is located within a recess 21*a*,21*b* in the housing 14 such that the production bore 12 is not obstructed.

Referring now to FIG. 3*b* it will be seen that in this position the hydraulic pistons have been actuated to push the pistons up to actuate the pin linkages 26*a*, 26*b* to act on the ram head 20*a*, 20*b*, as will be later described in detail so that the ram heads are moved into contact as shown in FIG. 3*b* to effectively close passage from bore 12*a* to 12*b* but permit passage from bore 12*b* to annulus portion 16*a*. This is achieved by virtue of the rams defining a guide funnel provided by an eccentric cone, 30 by cone portions 30*a*, 30*b* best seen in FIGS. 5*a* and 5*b* which forms the guide funnel to connect the bore 12*b* with the annulus portion 16*b* which is then connected to the annulus 16 so as to guide tools passing through the bore selector device into the annulus as will be later described.

It will thus be appreciated that the axial movement of the pistons 24*a*, 24*b* is converted by the linkage mechanism 26*a*, 26*b* into orthogonal movement of the ram heads i.e. they move at 90 degrees to the piston movement to close off the main bore 12*b*.

This is achieved using the ram link mechanism as best illustrated in FIGS. 6*a*, 6*b* and 6*c*. For convenience only, portion 26*a* is disclosed in detail but it will be appreciated that the operation of mechanism 26*b* is the same. The 4-pin linkage 26*a* consists of pins 32*a*, 34*a*, 36*a* and 38*a*. Pin 32*a* is coupled to the hydraulic cylinder 24*a*, pin 36*a* is coupled to the ram head and pin 38*a* is coupled to the housing 14 and is fixed. Pin 34*a* is coupled by the link 40*a* to pin 38*a*. The operation of the link mechanism will also be described with reference to the schematic diagram of FIG. 7. As the hydraulic ram 24*a* moves up, the hydraulic pressure causes pin 34*a* to move inwardly and, as pin 38*a* is fixed, pin 36*a* is also moved inwardly towards the centre line 40 of the bore selector device, and as ram head 20*a* is coupled by 36*a* the head is faced inwards to the central axis 40 of the tool. At mid stroke, as best seen in FIG. 6*b*, it can be seen that pins 34*a* and 36*a* are displaced towards the centre axis 40 and this continues with upward movement of the hydraulic piston 24*a* with the pins 34*a* and 36*a* move such that the ram heads 20*a* is in the closed position. In this position, which is mirrored by mechanism 22*b* the bore 12*b* is closed so that the bore 12*b* is fed into the eccentric cone 30 best seen in FIG. 5*b* which connects tube 12*b* to annular portion 16*b*.

When it is desired to open the bore the procedure is reversed with the pistons 24*a*, 24*b* being actuated to move downwardly and this retracts the linkage mechanism and the ram heads 20*a*, 20*b* back to the position shown in FIG. 6*a*.

Figures 8A, 8B, 8C, 8D, 8E:
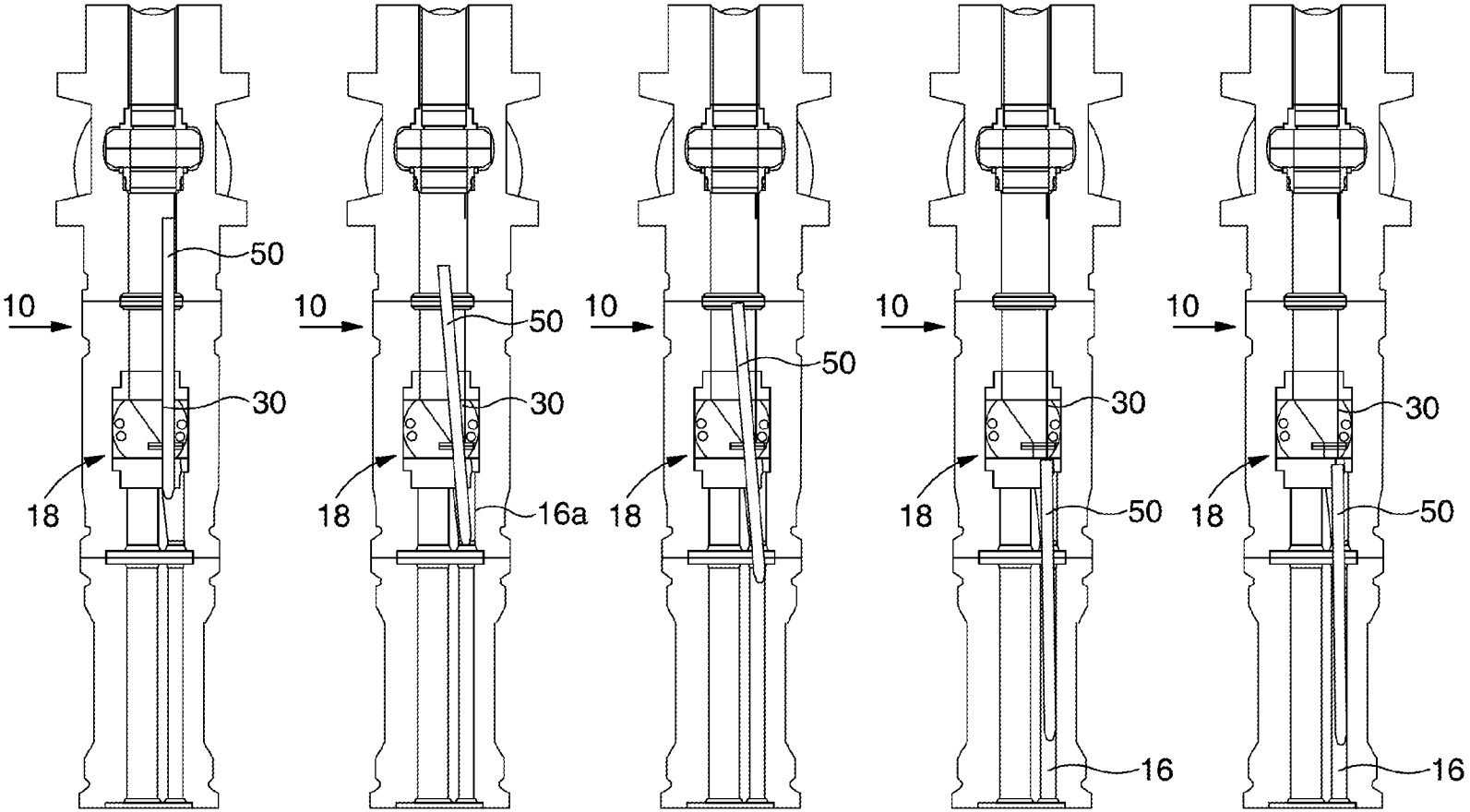

Reference is now made to FIGS. 8*a* to 8*c* of the drawings which is a schematic diagram of a bore selection device 10 in accordance with the invention illustrating the bore selector in the open position and showing how a 2 inch diameter×42 inch long drift 50 passes through the selector mechanism 18. It will be seen from FIGS. 8*a* to 8*e* that the long drift is guided through the funnel portion 30 into the annulus portion 16*a* (FIG. 8*b*) and then from annulus portion 16*a* into annular 16 as is finally seen in FIG. 8*e*.

It will be understood that the present invention offers various advantages over the prior art, namely that this is a compact arrangement which does not require the use of a ball valve and which translates vertical movement of pistons disposed axially in a housing into transverse horizontal movement to form a guide funnel within the device to close off the main production bore but still allow access from the main bore, and to the rig, to the annulus bore to provide all of the access and control functions required to the annulus. The use of the hydraulic closing mechanism and rams provides effective and reliable control which is not hitherto demonstrated with prior art devices.

Various modifications may be made to the apparatus here before described without departing from the scope of the invention. For example, it will be understood that the linkage mechanism and rams may be disposed to close and provide a funnel or eccentric cone such that the rams do not have to move at exactly 90 degrees to the piston movement. They can use the same principle but can be angled such that an eccentric cone is provided to connect the main bore of the bore selector device with the annulus bore. In addition it will be understood that the hydraulic mechanism may be replaced by an electrically operated mechanism or by a mechanical arrangement which could be coupled to a revolving operator vehicle (ROV) for driving the operation of the device. Also, it will be understood that in the hydraulic arrangement, an annular piston may replace the hydraulic piston illustrated.

Furthermore the bore selector means can be provided by any suitable number of rams with ram heads defining part of a funnel shape for example, 3, 4, 5, etc. When the rams are closed the rams heads form a guide funnel similar to that shown in FIG. 5*b*. Also a ram head may include a single guide funnel such as is shown in FIG. 5*b* with the ram head being carried by a single ram, which would be disposed in a single recess in the housing and when activated would, using the linkage, move orthogonally across the bores to close off the lower part of the product bore and couple the upper part of the bore to the annulus bore as already described with reference to FIGS. 1-7.

The invention claimed is:

1. A bore selection device for use with a dual bore sub-sea system, said bore selection device comprising:

a housing having a longitudinal axis, said housing defining a production bore and an annulus bore, said production bore being of a diameter larger than said annulus bore and extending the length of the housing, said annulus bore extending part-way along the length of said housing;

a bore selector movable between a first position wherein the production bore is open and said annulus bore is closed and a second position wherein the production bore is closed and said annulus bore is open;

the bore selector being coupled to an actuator by a coupler, said actuator and coupler being disposed in said housing, said actuator being movable substantially parallel to said production bore, said coupler coupling said actuator to said bore selector to transform longitudinal movement of said actuator to transverse movement of said bore selector to said production bore whereby said bore selector is moved between said first and said second positions.

2. A device as claimed in claim 1 wherein the housing has an internal wall defining cavities for receiving at least two actuators, said actuators being arranged to move in said wall in the direction parallel to the longitudinal axis.

3. A device as claimed in claim 1 wherein the bore selector includes two separate rams.

4. A device as claimed in claim 3 wherein said rams are equal in size and are dimensioned and proportioned so that in a first position when the production bore is open, each ram is located within a recess in said housing such that the production bore is not obstructed.

5. A device as claimed in claim 1 wherein the coupler couples each actuator to a respective ram and includes a linkage, said linkage being located within a wall of said housing, said actuator being a hydraulic system.

6. A device as claimed in claim 5 wherein said actuator is hydraulically actuated to close said production bore and hydraulic pistons engage the linkage which acts on respective rams to move the rams in a direction substantially orthogonal to the direction of said actuator so that the rams move together to close said production bore and define a guide funnel through said closed rams whereby a portion of said production bore is coupled to said annulus bore.

7. A device as claimed in claim 5 wherein the bore selector is provided by 3 or more rams with each ram defining part of a guide funnel such that when the rams are actuated and closed the guide funnel is formed.

8. A device as claimed in claim 1 wherein a single ram may be provided with a complete guide funnel which is dimensional and proportioned to fit in a wall of the housing when the production bore is open.

9. A device as claimed in claim 1 wherein said coupler is provided by a 4-pin linkage which acts to convert the longitudinal force of the hydraulic actuator within the bore selector device to an orthogonal force whereby said bore selector moves transverse to open and close the selected bores.

10. A device as claimed in claim 1 wherein the production bore extends the length of the housing when the bore selector is in both the first and second positions.

11. A method of selecting a bore within a dual bore sub-sea device having a production bore and a separate annulus bore, said method comprising the steps of:

actuating a first actuator to move in a first direction substantially parallel to the production bore of the dual sub-sea device;

coupling the longitudinal movement of the actuator to at least one ram via a coupler for converting the longitudinal movement to substantially transverse movement of said at least one ram, said transverse movement of said at least one ram moving between a first position wherein the production bore is open and a second position wherein the production bore is closed.

12. A method as claimed in claim 11 wherein said coupler transforms the longitudinal movement to transverse movement which is substantially orthogonal to the longitudinal movement so that said at least one ram moves between said first and second positions in a plane which is substantially orthogonal to the longitudinal axis of said housing.

13. A method as claimed in claim 11 wherein the method includes creating a funnel when said rams are closed which couples the production bore to the annulus bore.

14. A method as claimed in claim 11 wherein the method includes the step of actuating at least two hydraulic pistons and two separate rams to move orthogonally to said hydraulic pistons in opposite directions to provide said open and closed positions.

15. A method as claimed in claim 11 wherein the production bore extends the length of the dual bore sub-sea device when the production bore is both open and closed.

* * * * *